US006254495B1

(12) United States Patent
Nakamura et al.

(10) Patent No.: US 6,254,495 B1
(45) Date of Patent: Jul. 3, 2001

(54) SOLID GOLF BALL

(75) Inventors: Atsushi Nakamura; Hisashi Yamagishi; Takashi Maruko; Yutaka Masutani, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/464,401

(22) Filed: Dec. 16, 1999

(30) Foreign Application Priority Data

Jul. 9, 1999 (JP) ..... 11-195817

(51) Int. Cl.[7] ..... A63B 37/04
(52) U.S. Cl. ..... 473/371; 473/376
(58) Field of Search ..... 473/367, 368, 473/370, 371, 373, 374, 376

(56) References Cited

U.S. PATENT DOCUMENTS 5,772,531 * 6/1998 Ohsumi et al. ..... 473/376
6,045,460 * 4/2000 Hayashi et al. ..... 473/376

* cited by examiner

*Primary Examiner*—Mark S. Graham
*Assistant Examiner*—Raeann Gorden
(74) *Attorney, Agent, or Firm*—Sughrue, Mion, Zinn, Macpeak & Seas, PLLC

(57) ABSTRACT

A solid golf ball of four layers or multilayer structure having a core, an enclosing layer, an intermediate layer, and a cover. The core is composed of a thermoplastic resin or elastomer and has a diameter of 3–18 mm and a Shore D hardness of 50–95. The enclosing layer is composed of a thermoplastic resin or elastomer. The golf ball offers pleasant feel and click when hit, improved durability, and increased distance.

12 Claims, 1 Drawing Sheet

SOLID GOLF BALL

BACKGROUND OF THE INVENTION

1. Field of the Invention

The present invention relates to a golf ball of a four layer or multilayer structure offering pleasant feel and click when hit, improved durability, and increased distance.

2. Related Art

A variety of multi-piece golf balls including three-piece and four-piece ball constructions have been developed over the past few years in order to improve ball performance. The practice is known of balancing a soft feel with good resilience in multi-piece golf balls by giving the ball a hardness distribution across its core in such a way as to retain both properties. The predominant concept for achieving a soft feel is to soften the core. It is generally believed that hardening the core compromises the feel.

By contrast, golf balls using hard cores are also known (see JP-A 10-127818 and 11-57070). The hard core is reduced in diameter so as to avoid any adverse effect on the soft feel. The use of a hard core allegedly contributes to pleasant click and improved distance performance when hit at low head speeds.

The golf balls disclosed in the above-referred patents has an intermediate layer of a rubber composition formed on the surface of the core. Regrettably, this gives rise to a new problem that stresses tend to concentrate at the interface between the core and the intermediate layer due to the hardness difference therebetween so that the soft rubber layer is sensitive to crack.

SUMMARY OF THE INVENTION

An object of the invention is to provide a solid golf ball of four or multilayer structure offering pleasant feel and click when hit, improved durability, and increased distance.

According to the invention, there is provided a solid golf ball of four or multilayer structure comprising a core, an enclosing layer around the core, an intermediate layer around the enclosing layer, and a cover around the intermediate layer. The core is comprised of a thermoplastic resin or thermoplastic elastomer as a base and has a diameter of 3 to 18 mm and a Shore D hardness of 50 to 95. The enclosing layer is comprised of a thermoplastic resin or thermoplastic elastomer as a base.

Preferably the intermediate layer is formed of a composition comprising polybutadiene as a base. Also preferably, each of the core, the enclosing layer and the intermediate layer has a high specific gravity filler blended therein. The enclosing layer typically has a thickness of 1.0 to 5.0 mm and a Shore D hardness which is at least 10 units lower than that of the core. The difference in Shore D hardness between the enclosing layer and the intermediate layer is preferably less than 40 units.

The invention is directed to a solid golf ball of multilayer structure comprising at least four layers: a core, an enclosing layer, an intermediate layer, and a cover. It has been found that when the core is formed primarily of a thermoplastic resin or thermoplastic elastomer to a diameter of 3 to 18 mm and a Shore D hardness of 50 to 95, and the enclosing layer is formed primarily of a thermoplastic resin or thermoplastic elastomer, the golf ball becomes durable against strikes and offers pleasant feel and click and travels good distance when hit. The use of a thermoplastic resin or elastomer as the small-diameter core makes the manufacture smooth and efficient as compared with the use of rubber compositions.

Since the characteristic of the properties of the resin as the core base have a relatively little influence on the overall ball, the ball maintains excellent performance and has improved durability, good resilience and stable distance performance.

BRIEF DESCRIPTION OF THE DRAWING

The objects, features and advantages of the invention will become more apparent from the following detailed description.

The only figure.

DETAILED DESCRIPTION OF THE INVENTION

Figure 1:
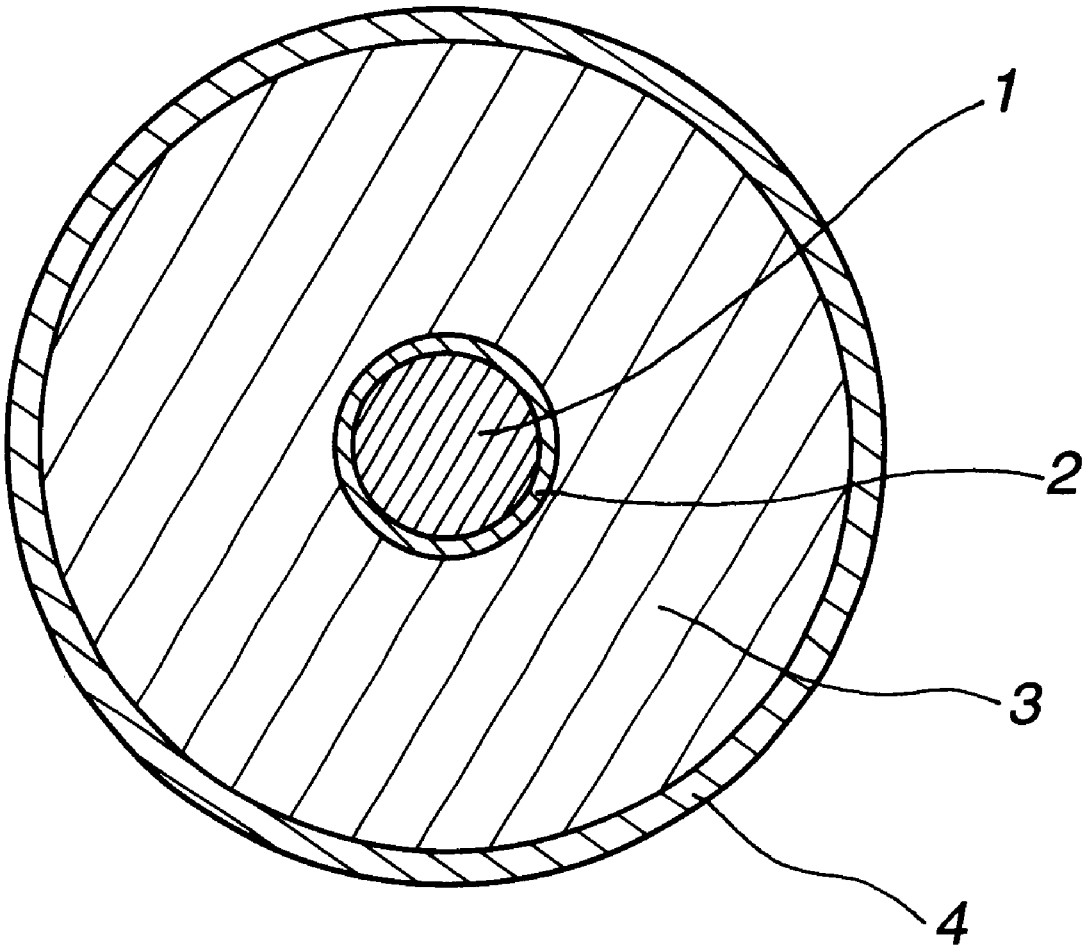
FIG. 1 is a sectional view showing a solid golf ball according to one embodiment of the invention.

Referring to FIG. 1, the solid golf ball according to one embodiment of the invention is illustrated as having a four-layer structure comprising a core 1, an enclosing layer 2 that encloses the core 1, an intermediate layer 3 that encloses the enclosing layer 2, and a cover 4 that encloses the intermediate layer 3. The core 1 has a small diameter as compared with prior art cores. The golf ball of the invention is not limited to the four layer structure illustrated herein and may be constructed of more layers. For example, the cover, though illustrated as a single layer, may be formed to a multilayer structure of two, three or more layers.

As opposed to the prior art golf balls in which the core is formed of rubber compositions, the core in the golf ball of the invention is formed of a composition comprising a thermoplastic resin or thermoplastic elastomer as a base. Typical are ionomer resins, thermoplastic polyamide elastomers, and thermoplastic polyester elastomers. Some examples of highly suitable commercial products include Surlyn (ionomer resins manufactured by E.I. DuPont de Nemours and Co.), Himilan (ionomer resins manufactured by Dupont-Mitsui Polychemicals Co., Ltd.), Amilan (thermoplastic polyamide elastomers by Toray Industries, Inc.), Rilsan (thermoplastic polyamide elastomers manufactured by Dupont-Toray Co., Ltd.) and Hytrel (thermoplastic polyester elastomers manufactured by Dupont-Toray Co., Ltd.).

An inorganic filler such as barium sulfate, titanium dioxide or zinc oxide may be compounded in the resin composition for weight adjustment purposes. It is preferred to add the inorganic filler in an amount of not more than 40 parts by weight, and especially not more than 38 parts by weight, per 100 parts by weight of the base. Too much inorganic filler may lower the workability of the composition during core manufacture.

The core may be formed by well-known techniques such as injection molding of a thermoplastic resin or elastomer base composition.

The core should have a diameter of at least 3 mm, preferably at least 3.5 mm, more preferably at least 4 mm, further preferably at least 5 mm, most preferably at least 8 mm and up to 18 mm, preferably up to 16 mm, more preferably up to 15 mm. A core with a diameter too small fails to exert its effect. A core having too large a diameter would adversely affect the rebound characteristics of the golf ball or cause rubber cracking, failing to ensure durability.

Also the core should have a Shore D hardness of at least 50, preferably more than 50, more preferably at least 52, and further preferably at least 60. The upper limit of Shore D hardness is 95, preferably 90, and more preferably 85. A core with too low a Shore D hardness, that is, a core too soft fails to improve the feel and click of the ball when hit. A core with too high a Shore D hardness gives a hard feel. The Shore D hardness referred to herein is measured according to ASTM D-2240.

Though not critical, the core preferably has a specific gravity of at least 1.00, more preferably at least 1.05, most preferably at least 1.10, with the upper limit being 1.60, and especially 1.50. A core with a too low specific gravity would sometimes require the intermediate layer having an increased specific gravity or detract from resilience whereas a core with a too high specific gravity would sometimes require to increase the amount of filler added, detracting from moldability.

The enclosing layer is formed so as to surround the core and must be composed primarily of a thermoplastic resin or thermoplastic elastomer. Use may be made of well-known thermoplastic resins and elastomers as exemplified above for the core material. Illustrative examples include ionomer resins, thermoplastic polyester elastomers and thermoplastic polyamide elastomers. Thermoplastic polyurethane elastomers are also useful. Some examples of suitable commercial products include Surlyn, Himilan and Hytrel mentioned above as well as Pandex (thermoplastic polyurethane elastomers manufactured by Dainippon Ink & Chemicals, Inc.).

Like the preparation of the core, the enclosing layer may be formed by an injection molding method involving, for example, placing the preformed core in a mold and injection molding the resin or elastomer material into the mold cavity.

The enclosing layer typically has a thickness or gage of from 1.0 to 5.0 mm, preferably from 1.2 to 4.0 mm, and especially 1.4 to 3.0 mm. Too thin an enclosing layer would exert to a less extent the effect of mitigating stress concentration in the intermediate layer and allow rubber fissuring in the intermediate layer. If the enclosing layer is too thick, the intermediate layer must be made thin due to the structural balance of the uncovered ball (that is, the sphere consisting of core, enclosing layer and intermediate layer prior to formation of the cover), which would compromise resilience and moldability.

The enclosing layer is preferably formed of such a material that the enclosing layer at the interface with the core may have a Shore D hardness which is at least 10 units, more preferably at least 12 units, lower than that of the core. If the hardness difference between the core and the enclosing layer is smaller, the click of the ball when hit would not be improved. Preferably the enclosing layer itself has a Shore D hardness of 15 to 60, more preferably 20 to 55, and most preferably 25 to 50.

For the intermediate layer, a rubber composition is advantageously used because of the availability of resilience. Thermoplastic resins and thermoplastic elastomers are also useful. For example, ionomer resins, thermoplastic polyester elastomers and thermoplastic polyamide elastomers may be used.

When the intermediate layer is formed of rubber, a polybutadiene base rubber composition is preferred as in prior art golf ball cores. The use of cis-1,4-polybutadiene having a cis structure content of at least 40% is highly suitable. Where desired, other rubber components such as natural rubber, polyisoprene rubber or styrene-butadiene rubber may be compounded with polybutadiene as appropriate. The rebound characteristics of the golf ball can be improved by increasing the proportion of rubber components. The other components may be blended in an amount of up to about 10 parts by weight per 100 parts by weight of the polybutadiene.

A crosslinking agent may be blended in the rubber composition. Exemplary crosslinking agents are the zinc and magnesium salts of unsaturated fatty acids (e.g., zinc methacrylate, zinc acrylate), and ester compounds (e.g., trimethylpropane methacrylate). Zinc acrylate is especially preferred for imparting high resilience. The crosslinking agent is preferably blended in an amount of about 10 to 40 parts by weight per 100 parts by weight of the base rubber.

A vulcanizing agent can generally be compounded in the rubber composition. It is recommended that the vulcanizing agent include a peroxide, an example of which is Perhexa 3M commercially available from Nippon Oils and Fats Co., Ltd. The amount of peroxide blended is preferably set at from about 0.6 to 2 parts by weight per 100 parts by weight of the base rubber.

If necessary, antioxidants, and fillers such as zinc oxide or barium sulfate for adjusting the specific gravity may be blended in the rubber composition. The amount of such specific gravity modifiers is preferably from about 1 to 30 parts by weight per 100 parts by weight of the base rubber.

The intermediate layer may be produced from such a rubber composition by a known vulcanization and curing process. Use is preferably made of a two-step process in which the rubber composition is first subjected to primary vulcanization (semi-vulcanization) in a mold to form a pair of hemispherical cups. The core about which the enclosing layer has been formed is then placed in one of the hemispherical cups, the other cup is closed over this, and secondary vulcanization (full vulcanization) is carried out.

In the practice of the invention, the intermediate layer may be either a single layer or a multilayer structure of two or more layers. In the latter case, a first layer is formed of the above-described rubber composition and a second layer (and other layers if any) may be formed of a similar rubber composition or a resin base composition, and preferably the rubber composition. The intermediate layer is preferably formed to such a thickness that the solid core consisting of the core, enclosing layer and intermediate layer may have a diameter of 34.0 to 41.0 mm, and especially 34.5 to 40.0 mm.

In one preferred embodiment, when the enclosing layer and the intermediate layer are respectively measured for Shore D hardness near the interface therebetween, the difference in Shore D hardness between the enclosing layer and the intermediate layer is less than 40 units, more preferably 0 to 38 units, further preferably 0 to 35 units, most preferably less than 33 units. Either the enclosing layer or the intermediate layer may have a higher hardness although it is preferred that the intermediate layer have a higher hardness. A too large hardness difference would allow stresses to concentrate at the interface between the enclosing layer and the intermediate layer, impairing durability and hence, the objects of the invention. It is noted that the Shore D hardness of the intermediate layer is determined by cutting the ball into halves, and making measurement on the smooth cross section of the hemisphere. The Shore D hardness of the enclosing layer is measured according to ASTM D-2240.

The Shore D hardness of the intermediate layer itself is adjusted as appropriate depending on the hardness of the enclosing layer. Typically the Shore D hardness of the intermediate layer is from 25 to 65, more preferably from 30 to 60, most preferably from 35 to 55. If the Shore D hardness of the intermediate layer is too low, the hardness difference from the core becomes too large, which would cause rubber fissuring. If the Shore D hardness of the intermediate layer is too high, the feel would become hard, failing to achieve the objects of the invention.

High specific gravity fillers may be blended in any one of the core material, the enclosing layer material, and the intermediate layer material, especially in all of them. Exemplary high specific gravity fillers are barium sulfate and tungsten. The amount of such filler blended in one layer is adjusted in accordance with the weight balance of the ball and the like, although an appropriate amount is up to 40 parts, more preferably up to 38 parts, and most preferably up to 35 parts by weight per 100 parts by weight of the base component in each layer. The high specific gravity filler may be omitted if unnecessary. The balance of filler contents in the respective layers is important since blending an excessive amount of filler in any one layer can impede the working of that material.

The golf ball of the invention is formed by enclosing the intermediate layer-enclosed core with a cover. Known golf ball cover stock materials may be used, suitable examples of which include ionomer resins, polyurethane-, polyamide- and polyester-based thermoplastic elastomers, and balata rubber. Any well-known filler may be added thereto if necessary. A conventional injection molding or other suitable technique may be used to form the cover.

Preferably, the cover has a thickness or gage of 0.8 to 4.3 mm, more preferably 1.0 to 3.5 mm, further preferably 1.4 to 2.5 mm, and most preferably 1.5 to 2.3 mm. If the cover is given a multilayer structure, the plural layers should be adjusted to an overall thickness within the above-described range. Too thin a cover would fail to render the ball durable whereas a too thick cover would impair the feel.

It is recommended that at least one layer of the cover be harder than the intermediate layer. Typically the cover has a Shore D hardness of 40 to 70, and preferably 50 to 68.

As in conventional golf balls, the golf ball of the invention has numerous dimples formed on the surface of the cover. The total number of dimples is preferably from 350 to 500, more preferably from 370 to 480, and most preferably from 390 to 450. The dimples may be distributed in a geometrical arrangement that is octahedral or icosahedral, for example. Nor is the dimple pattern limited to a circular pattern, the use of any other suitable pattern, such as a square, hexagonal, pentagonal or triangular pattern, also being acceptable.

The inventive golf ball may be formed so as to have a diameter and weight which are in accordance with the Rules of Golf; that is, a diameter not passing the ring of 42.67 mm, preferably from 42.67 mm to 42.75 mm and a weight of not more than 45.93 grams, preferably 45.2 grams to 45.8 grams.

There has been described a golf ball offering pleasant feel and click when hit, improved durability, and increased distance.

EXAMPLES

Examples of the invention and comparative examples are given below by way of illustration, and are not intended to limit the invention.

Examples 1–5 and Comparative Examples 1–3

Cores having the characteristics shown in Table 1 were produced by injection molding the resin-based compositions in Table 1 into a mold.

Next, an enclosing layer was formed around the core using the resin-based compositions shown in Table 1.

An intermediate layer was formed in each example by working the rubber composition shown in Table 1 with a roll mill, then subjecting the worked composition to primary vulcanization (semi-vulcanization) in a mold at 130° C. for 6 minutes to give a pair of hemispherical cups. The pair of hemispherical cups was closed as the intermediate layer over the core portion of the ball composed of the core and the enclosing layer, then subjected to secondary vulcanization (full vulcanization) in a mold at 155° C. for 15 minutes, giving a sphere composed of the core surrounded by two layers.

The sphere of Comparative Example 2 was prepared in a different way from the above. As shown in Table 1, rubber compositions were used for the core, the enclosing layer and the intermediate layer. The core employed a vulcanizing step at 155° C. for 20 minutes. The enclosing layer and intermediate layer each employed the same two-step compression molding process as described above.

A cover was then formed in each example by injection molding a material formulated as shown in Table 1 about the intermediate layer to give golf balls bearing dimples of the same shape, arrangement and number on the surface.

In Table 1, the Shore D hardness of the core is as measured according to ASTM D-2240, and the hardness of the enclosing layer and the intermediate layer from which a hardness difference is calculated is a hardness on the surface of the respective layers as formed.

The resulting golf balls were evaluated for various properties. Using a swing robot, the ball was hit with a driver at a head speed of 40 m/s and the carry and total distance were measured.

Durability

Using a swing robot, the ball was successively hit 50 times with a driver. The initial velocity at which the ball launched was measured each time. The initial velocity drastically drops if rubber fissure occurs in the ball interior. The ball was rated "X" when a drop of initial velocity was found and "O" when no drop was found until the last strike.

Feel

The feel of the golf ball when hit with a club was rated "O" for an appropriate soft and solid feel, "Δ" for a too soft feel, and "X" for a hard feel.

Click

The click of the golf ball when hit with a club was rated "O" for an appropriate pleasant click, "Δ" for an average click, and "X" for a dead click.

The results are also shown in Table 1.

TABLE 1

| | | | EX 1 | EX 2 | EX 3 | EX 4 | EX 5 | CE 1 | CE 2 | CE 3 |
|---|---|---|---|---|---|---|---|---|---|---|
| Core | Composition (pbw) | Surlyn 8220 (ionomer) | | 100 | | | 100 | | | 100 |
| | | Amilan CM1007 (polyamide) | 100 | | 100 | 100 | | | | |
| | | Rilsan BMNO (polyamide) | | | | | | 100 | | |
| | | 1,4-cis-polybutadiene | | | | | | | 100 | |
| | | Zinc oxide | | | | | | | 5 | |
| | | Zinc diacrylate | | | | | | | 5 | |
| | | Dicumyl peroxide | | | | | | | 1 | |
| | | Barium sulfate | 20 | 33 | | | | 45 | 35 | |
| | | Tungsten | | | 15 | | 20 | | | 20 |
| | Specifications | Diameter (mm) | 15.0 | 12.0 | 10.0 | 6.0 | 13.0 | 25.0 | 18.0 | 20.0 |
| | | Weight (g) | 2.3 | 1.1 | 0.7 | 0.1 | 1.3 | 10.9 | 3.6 | 4.7 |
| | | Shore D hardness | 87 | 72 | 86 | 86 | 71 | 80 | 32 | 71 |
| Enclosing layer | Composition (pbw) | Surlyn 8120 (ionomer) | | | | | 60 | | | |
| | | Himilan 1605 (ionomer) | | | | | 40 | | | 50 |
| | | Himilan 1706 (ionomer) | | | | | | | | 50 |
| | | Hytrel 3046 (polyester) | | | | 100 | | | | |
| | | Hytrel 4001 (polyester) | | 100 | 100 | | | | | |
| | | Hytrel 4701 (polyester) | 100 | | | | | | | |
| | | 1,4-cis-polybutadiene | | | | | | | 100 | |
| | | Zinc oxide | | | | | | | 5 | |
| | | Zinc diacrylate | | | | | | | 37 | |
| | | Dicumyl peroxide | | | | | | | 1.2 | |
| | | Barium sulfate | | | | 10 | 20 | | 16 | 30 |
| | Specifications | Primary vulcanization | | | | | | | 130° C./6 min | |
| | | Secondary vulcanization | | | | | | | 155° C./15 min | |
| | | Diameter inclusive of core (mm) | 20.0 | 17.0 | 14.0 | 10.0 | 25.0 | | 30.0 | 30.0 |
| | | Thickness (mm) | 2.5 | 2.5 | 2.0 | 2.0 | 6.0 | | 6.0 | 5.0 |
| | | Weight inclusive of core (g) | 5.1 | 3.0 | 1.7 | 0.6 | 9.0 | | 16.5 | 16.3 |
| | | Shore D hardness | 47 | 40 | 40 | 30 | 58 | | 60 | 63 |
| | | Hardness difference between core and enclosing layer | 40 | 32 | 46 | 56 | 13 | | −28 | 8 |
| Intermediate layer | Composition (pbw) | 1,4-cis-polybutadiene | 100 | 100 | 100 | 100 | 100 | 100 | 100 | 100 |
| | | Zinc oxide | 5 | 5 | 5 | 5 | 5 | 5 | 5 | 5 |
| | | Barium sulfate | 27.0 | 27.0 | 33.0 | 33.0 | 33.0 | 5.0 | 22.0 | 5.0 |
| | | Zinc diacrylate | 22.0 | 22.0 | 19.0 | 19.0 | 25.0 | 5.0 | 30.0 | 33.0 |
| | | Dicumyl peroxide | 1.2 | 1.2 | 1.2 | 1.2 | 1.2 | 1.2 | 1.2 | 1.2 |
| | Specifications | Primary vulcanization | 130° C./6 min | 130° C./6 min | 130° C./6 min | 130° C./6 min | 130° C./6 min | 130° C./6 min | 130° C./6 min | 130° C./6 min |
| | | Secondary vulcanization | 155° C./15 min | 155° C./15 min | 155° C./15 min | 155° C./15 min | 155° C./15 min | 155° C./15 min | 155° C./15 min | 155° C./ |
| | | Diameter inclusive of core end enclosing layer (mm) | 38.5 | 38.5 | 38.5 | 38.5 | 38.5 | 39.5 | 38.5 | 38.5 |
| | | Thickness (mm) | 9.3 | 10.8 | 12.3 | 14.3 | 6.8 | 7.3 | 4.3 | 4.3 |
| | | Weight inclusive of core and enclosing layer (g) | 35.0 | 35.0 | 35.0 | 35.0 | 35.0 | 35.0 | 35.0 | 35.0 |
| | | Surface Shore D hardness | 50 | 50 | 56 | 56 | 58 | 33 | 56 | 58 |
| | | Hardness difference between enclosing layer and intermediate layer | 3 | 10 | 16 | 26 | 0 | −47 | −4 | −5 |
| Cover | Composition (pbw) | Himilan 1605 (ionomer) | | | 50 | 50 | 50 | 50 | 50 | 50 |
| | | Himilan 1706 (ionomer) | | | 50 | 50 | 50 | 50 | 50 | 50 |
| | | Himilan 1557 (ionomer) | 50 | 50 | | | | | | |
| | | Himilan 1601 (ionomer) | 50 | 50 | | | | | | |
| | Specifications | Shore D hardness | 58 | 58 | 62 | 62 | 62 | 62 | 62 | 62 |
| | | Thickness (mm) | 2.1 | 2.1 | 2.1 | 2.1 | 2.1 | 1.6 | 2.1 | 2.1 |
| Ball | Specifications | Weight (g) | 45.3 | 45.3 | 45.3 | 45.3 | 45.3 | 45.3 | 45.3 | 45.3 |
| | | Diameter (mm) | 42.7 | 42.7 | 42.7 | 42.7 | 42.7 | 42.7 | 42.7 | 42.7 |
| | HS = 40 m/s | Carry (m) | 195.0 | 193.0 | 192.0 | 192.0 | 192.5 | 191.7 | 192.0 | 190.0 |
| | | Total (m) | 212.0 | 209.5 | 209.0 | 210.5 | 210.0 | 208.6 | 208.0 | 207.0 |
| | | Feel | ○ | ○ | ○ | ○ | ○ | Δ | X | X |
| | | Click | ○ | ○ | ○ | ○ | ○ | Δ | Δ | X |
| | | Durability | ○ | ○ | ○ | ○ | ○ | X | X | X |

Japanese Patent Application No. 11-195817 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball of multilayer structure comprising a core, an enclosing layer around the core, an intermediate layer around the enclosing layer, and a cover around the intermediate layer, wherein said core consist essentially of a thermoplastic resin or thermoplastic elastomer and has a diameter of 3 to 18 mm and a Shore D hardness of 50 to 95, and said enclosing layer consist essentially of a thermoplastic resin or thermoplastic elastomer and has a thickness of 1.0 to 5.0 mm and a Shore D hardness which is at least 10 units lower than that of said core.

2. The golf ball of claim 1 wherein said intermediate layer is formed of a composition comprising polybutadiene as a base.

3. The golf ball of claim 1 wherein each of said core, said enclosing layer and said intermediate layer has a high specific gravity filler blended therein.

4. The golf ball of claim 1 wherein the difference in Shore D hardness between said enclosing layer and said intermediate layer is less than 40 units.

5. The golf ball of claim 1, wherein said enclosing layer itself has a Shore D hardness of 15 to 60.

6. The golf ball of claim 1, wherein said thermoplastic resin or thermoplastic elastomer includes ionomer resins, thermoplastic polyamide elastomers, and thermoplastic polyester elastomers.

7. The golf ball of claim 1, wherein said intermediate layer has a Shore D hardness of 25 to 65.

8. The golf ball of claim 4, wherein the difference in Shore D hardness between said enclosing layer and said intermediate layer is less than 33 units when the enclosing layer and the intermediate layer are respectively measured for Shore D hardness near the interface therebetween.

9. The golf ball of claim 3, wherein said core has a specific gravity of 1.00 to 1.60.

10. The golf ball of claim 3, wherein said core has a specific gravity of 1.10 to 1.50.

11. The golf ball of claim 1, wherein said intermediate layer has a diameter of 34.0 to 41.0 mm.

12. The golf ball of claim 1, wherein said core has a diameter of 3 to 16 mm.

* * * * *